US005087039A

United States Patent [19]

Laseke

[11] Patent Number: 5,087,039

[45] Date of Patent: Feb. 11, 1992

[54] BASEBALL BAT SWING TRAINING DEVICE

[76] Inventor: Erik A. Laseke, 213 Whitman Rd., Winter Haven, Fla. 33884

[21] Appl. No.: 674,893

[22] Filed: Mar. 26, 1991

[51] Int. Cl.[5] ..... A63B 69/40

[52] U.S. Cl. ..... 273/26 R

[58] Field of Search ..... 273/26 R, 29 A, 26 E, 273/95 A, 191 A, 191 R, 181 J, 184 B, 185 C, 196, 197 A, 200 B

[56] References Cited

U.S. PATENT DOCUMENTS

| | | | |
|---|---|---|---|
| 2,696,383 | 12/1954 | Nofstsinger | 273/55 |
| 2,985,452 | 5/1961 | Trippet | 273/26 R |
| 3,904,199 | 9/1975 | Burchett | 273/26 R |
| 3,937,464 | 2/1976 | Zalewski | 273/26 R |
| 3,940,131 | 2/1976 | Claire, Jr. | 273/26 R |
| 4,508,339 | 4/1985 | Lewellyn | 273/26 E |

*Primary Examiner*—Theatrice Brown
*Attorney, Agent, or Firm*—William M. Hobby

[57] ABSTRACT

A baseball bat swing training apparatus includes a base which sits on the ground with a vertically extending post extending from the base. A baseball bat swing guide is attached to the post which has a pair of parallel swing guide connected at one end and open at the other end. The swing guide arms are positioned at a predetermined slope to the post of between 50 and 80 degrees. Each arm has an approximately 90 degree bend therein to form a bent U-shape. A ball holding cup can be attached to the lower arm while the ball holder can be attached to the upper arm and the vertically extending post is a telescoping post for adjusting the height thereof and may be a dual post. A second embodiment has a pair of posts and a pair of base members for supporting a pair of swing guide arms.

9 Claims, 2 Drawing Sheets

BASEBALL BAT SWING TRAINING DEVICE

BACKGROUND OF THE INVENTION

This invention relates to a baseball bat swing training apparatus for assisting a baseball player in practicing his swing for insuring a proper swing.

It is well known in the sport of baseball for a player to achieve the maximum benefit from his power in hitting a ball he must have a proper swing over the strike zone and there have been many prior devices for training a baseball player in his swing. These usually include a pair of spaced horizontally disposed parallel arms sometimes having means for holding a ball associated with one of the parallel arms. The arms are usually mounted to a plate having a track therein providing for adjustment of the arms in the horizontal direction.

In prior U.S. Pat. No. 2,443,131, means are provided for assisting a player in developing a level swing. This device is not entirely successful in accomplishing the objective because it does not provide for realistic contact with a baseball and does not provide for adjustability depending upon the areas relative to the strike zone a player is having difficulty maintaining a level swing in. In U.S. Pat. No. 3,940,131 a training device is shown which provides vertically spaced horizontal extending arms which may be raised or lowered to various positions. In U.S. Pat. No. 3,904,199 a device for assisting a baseball player in practicing his swing is shown having a pair of spaced horizontally disposed parallel arms having means for holding a ball associated with the bottom arm. The arms are mounted to a plate having a track therein providing for adjustment of the arms in a horizontal direction. In U.S. Pat. No. 4,516,771, a batting practice device has arms vertically spaced from one another and extending substantially horizontal from the mounting plate to form an unobstructed substantially horizontal target area for passage of a bat therebetween during a practice swing. In the Ferretti U.S. Pat. No. 3,039,770, an adjustable pitching tee is provided having a telescoping post for holding a baseball or the like for batting practice. These prior art devices typically extend a pair of horizontally extending arms parallel to each other with the batter positioned directly in front of the ends of the arms for swinging between the arms.

In contrast to these devices, the present invention has the batter standing beside a pair of sloping parallel arms so that the bat is guided through a slope swing over the length of the parallel arms to control the swing as the bat approaches the plate. To accomplish this, the arms must be cantilevered in such a fashion so that the arms are supported out of the way at both ends for swinging the bat through the length of the arms and this is accomplished in the present invention with a pair of parallel arms forming a bent "U" shape positioned at a predetermined slope.

SUMMARY OF THE INVENTION

A baseball bat swing training apparatus includes a base which sits on the ground with a vertically extending post extending from the base. A baseball bat swing guide is attached to the post which has a pair of parallel swing guide arms connected at one end and open at the other end. The swing guide arms are positioned at a predetermined slope to the post of between 50 and 80 degrees. Each arm has an approximately 90 degree bend therein to form a bent U-shape. A ball holding cup can be attached to the lower arm while the ball holder can be attached to the upper arm and the vertically extending post is a telescoping post for adjusting the height thereof and may be a dual post. A second embodiment has a pair of posts supported by a pair of base members for supporting a pair of swing guide arms at a predetermined slope.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

Figure 1:
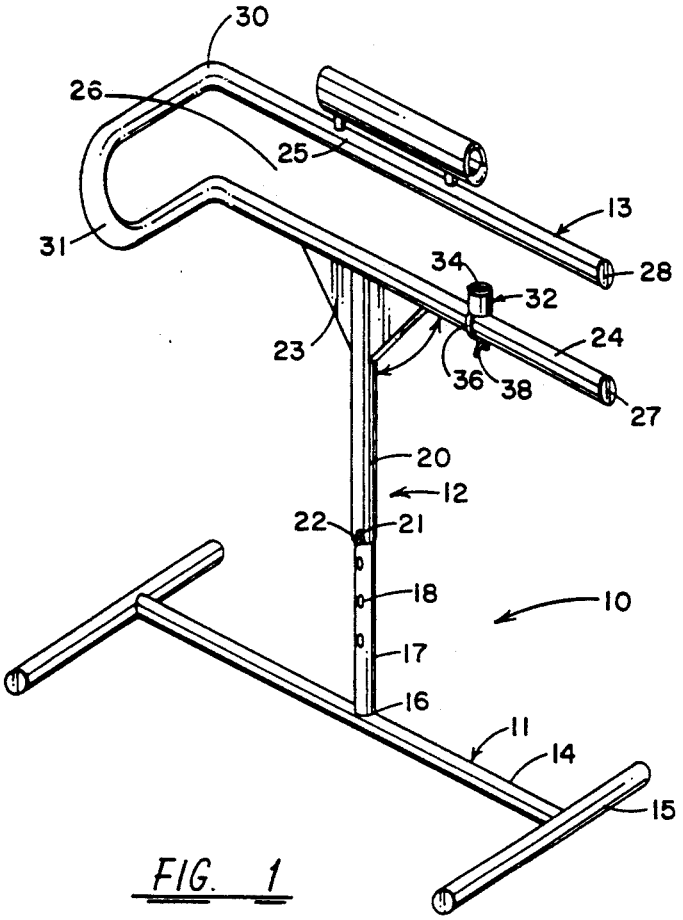
FIG. 1 is a baseball bat swing training apparatus in accordance with the present invention.
Figure 3:
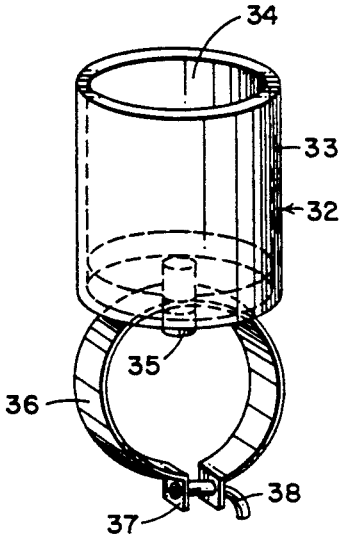
FIG. 3 is a perspective view of the ball tee of FIG. 1.
Figure 2:
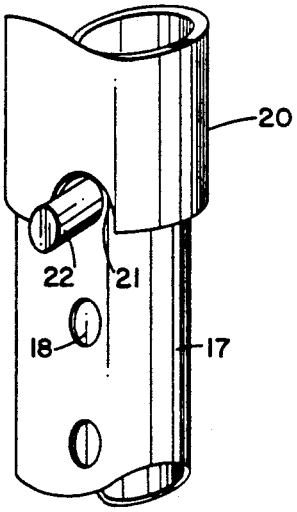
FIG. 2 is a cutaway perspective of the telescoping lock of the swing training apparatus of FIG. 1.

Referring to FIGS. 1-3 of the drawings, a baseball bat swing training apparatus 10 has a 12 supporting base 11 with a vertically extending post 12 supporting a baseball bat swing guide 13. The base 11 has an elongated pipe 14 having a pair of legs 15 extending transverse to the elongated pipe 14. The elongated pipe 14 is attached by a weld 16 to the vertically extending post 12. Post 12 has a telescoping member 17 having a plurality of openings 18 therein and a telescoping member 20 sliding over the telescoping member 17 and having an arcuate notch 21 on two sides thereof so that a pin 22 can be inserted through one of the apertures 18 in the post member 17 and the post member 20 allowed to rest on the pin 22 in the arcuate cutout 21 to prevent the rotation of the telescoping member 20 and the baseball swing guide 13. A pair of brace members 23 are attached to the post member 20, such as by welding, and to the bottom arm 24 of the baseball bat swing guide 13. The swing guide member 13 also has a top arm 25 which is mounted parallel to the arm 24 in a spaced relationship to the arms so that the space 26 between the arms acts as a baseball bat guide during a practice swing. The swing guide 13 is mounted at a sloping angle between 50 and 80 degrees to align the perfect swing from the side thereof. The arm 24 has an open end 27 while the arm 25 has an open end 28 and both arms are bent approximately 90 degrees at the bend 30 and then are connected to each other with an arcuate end 31. Thus, the arms 24 and 25 with the bends 30 and the connected end 31 form a generally bent U-shape. A batter standing beside the apparatus of FIG. 1 would swing into the swing guide 13 between the bends 30 in the arms 24 and 25 and would continue the swing in a downward direction through the slope and out the open end of the swing guide.

A baseball holding tee 32 is illustrated in FIGS. 1 and 3 which has a cup 33 with an open end 34 and attached at the bottom with a pin 35 to a clamp 36 which has a pair of tabs 37 connected by clamping pin 38. In operation a baseball can be placed in the ball tee 32 with the batter standing to one side between transverse legs 15 for swinging the bat into the guide arms 24 and 25 at the bend portion 30 at a downward slope until they hit the ball sitting in the baseball tee 32. The bat would then continue on past the arm ends 27 and 28. The vertically extending posts 12 can be adjusted for height of an individual batter by removing the pin 22, as more clearly shown in FIG. 2, and placing it in a different opening 18 in the post member 17 and then allowing the member 20 slots 21 to fit onto the pin 22.

Figure 4:
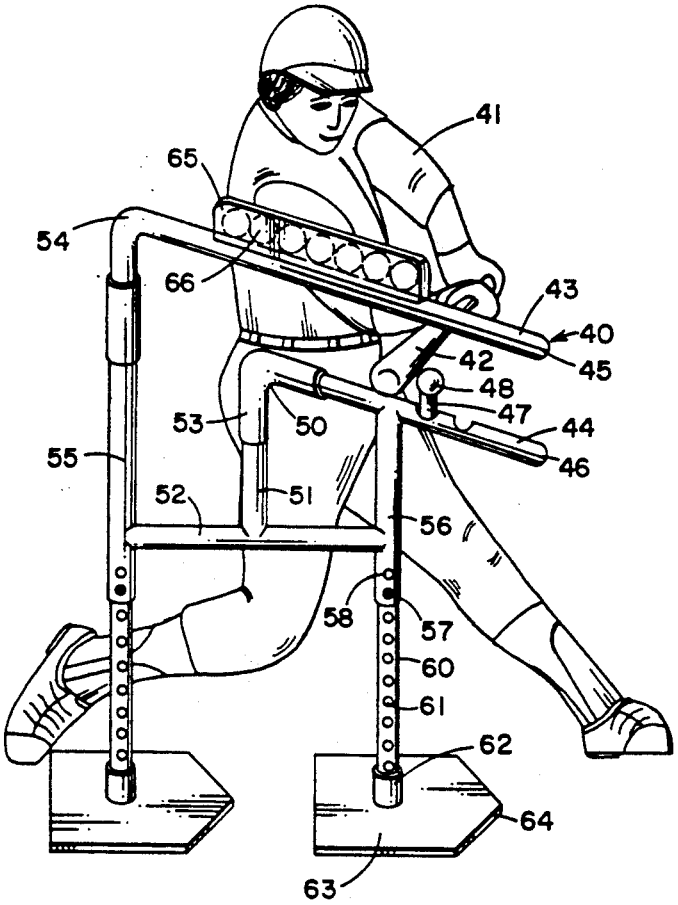
FIG. 4 is a perspective view of an alternate embodiment of a baseball bat swing training apparatus having a batter swinging thereinto.
Figure 5:
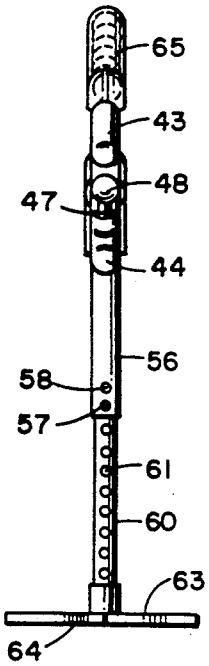
FIG. 5 is an end elevation of the bat swing training apparatus of FIG. 4.
Figure 6:
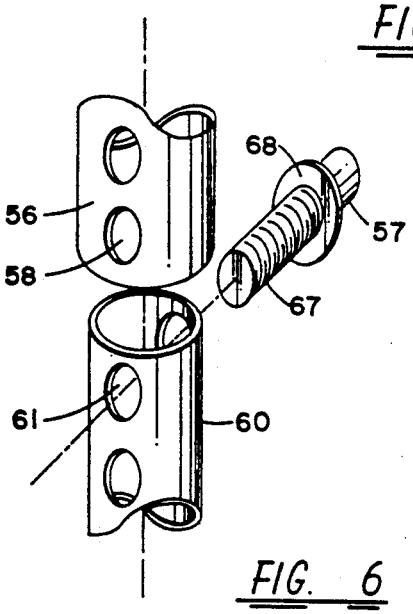
FIG. 6 is a cutaway exploded perspective of the telescoping attachment for the bat swing training apparatus of FIGS. 4 and 5.

Referring to FIGS. 4, 5 and 6, a second embodiment is illustrated. A baseball bat swing training device 40 has a batter 41 illustrated adjacent the training device swinging a baseball bat 42 between the swing guide arms 43 and 44. The swing guide arm 43 has a tip 45 while swing guide arm 44 has an end 46 forming an open end for the bat to swing through. Both arms are placed at an angle as in the embodiment of FIG. 1 and a baseball tee 47 can be positioned with a baseball 48 onto the arm 44. The arm 44 has an approximately 90 degree bend 50 bending to a downward vertical direction with a downwardly extending portion 51 attached to a horizontal frame member 52 and is covered with a resilient material, such as a foamed latex material 53 over the elbow 50 to absorb an accidental hitting with the bat.

Arm 43 has an approximately 90 degree elbow 54 connecting it to a vertically extending post member 55. A vertically extending post member 56 is connected to the bottom of the guide arm 44 while the frame member 52 is connected between the vertically extending members 55 and 56. A pair of pins 57 are inserted through openings 58 in the members 55 and 56 and also through the openings 60 in the telescoping vertically extending posts 61. Posts 61 are supported in a cylindrical support 62 welded to each of two base members 63, each of which has an arrow shaped front 64. A baseball holder 65 is mounted to top arm 43 and may have a plurality of baseballs 66 therein which can be removed one-at-a-time and placed on the tee 47.

As seen in FIG. 6, the pin 57 has a threaded portion 67 with a flange stop 68 for insertion in the opening 58 of the arms 56 and through the opening 60 in the telescoping post member 60.

This practice device along with the embodiments shown in FIG. 1 both position the batter beside the swing guide as shown in FIG. 4 and allow him to swing the bat within the swing guide between the guide arms at a baseball held in a baseball tee at a downward slope in accordance with good batting practice which slope may be 20 degrees sloping from horizontal. As the batter hits the ball, his swing is coming around to a level position. The batter can keep replacing balls from the ball holder 65 to continue his practice.

It should be clear at this time that a baseball bat swing training device has been provided which guides a bat at a predetermined slope and which may be adjusted vertically with telescoping posts to the proper height for a particular batter and which endeavors to force the batter not only to keep the bat level but to swing at the proper angle with the guide placed beside the batter. However, the present invention is not to be construed as limited to the forms shown or to be considered illustrative rather than restrictive.

I claim:

1. A baseball bat swing guide training apparatus comprising. A support base;

A vertically extending support post having its lower end attached to said support base, first and second guide arms, each having first and second end, said first guide arm being attached intermediate its ends to the upper end of said post, said second arm being vertically spaced above said first arm a predetermined distance and having its first end attached to said first end of said first arm, said guide arms being generally L-shaped and parallel to each other, said arms being attached to each other such that a straight portion thereof extend substantially horizontal and the remaining portion and said first end of each arm extend at a predetermined downward angle of between 50 and 80 degrees relative to said support post, whereby a batter can swing a bat between said arms at said second end and along said straight portion without being obstructed.

2. A baseball bat swing training apparatus in accordance with claim 1 in which each said bat swing guide arm has an arcuate end connecting said pair of swing guide arms at said first end.

3. A baseball bat swing training apparatus in accordance with claim 2 in which said first arm of said bat swing guide apparatus has a ball holding cup attached thereto.

4. A baseball bat swing training apparatus in accordance with claim 3 in which said ball holding cup is adjustably attached to said first arm.

5. A baseball bat swing training apparatus in accordance with claim 4 in which said vertically extending post is a telescoping post.

6. A baseball bat swing training apparatus in accordance with claim 5 in which base has a center elongated leg having two transverse legs attached thereto.

7. A baseball bat swing training apparatus in accordance with claim 6, in which said baseball bat swing guide apparatus has a ball holder attached to the top of said second arm of said pair of swing guide arms.

8. A baseball bat swing training apparatus in accordance with claim 7 in which said vertically extending post is a telescoping post having a plurality of apertures therein and a connecting pin to fit into said apertures for adjusting vertical position of said swing guide arms.

9. A baseball bat swing training apparatus in accordance with claim 8 in which said telescoping post is two telescoping members and includes a larger cylindrical member sliding over a smaller cylindrical member and the larger cylindrical member having a pair of cutout portions resting over a support pin passing through the apertures in said telescoping post to thereby prevent said swing guide member from rotating one telescoping member relative to the second telescoping member.

* * * * *